US007871272B2

(12) United States Patent
Firman, II et al.

(10) Patent No.: US 7,871,272 B2
(45) Date of Patent: Jan. 18, 2011

(54) SLIDING WINDOW MAGNETIC ELECTRICAL CONNECTOR

(75) Inventors: Gary Lee Firman, II, White Lake, MI (US); David J. Rutkowski, Grosse Ile, MI (US); Gregory J. Holland, Wolcott, CT (US); Ma Ming, Jiangsu (CN)

(73) Assignee: Casco Products Corporation, Bridgeport, CT (US)

( * ) Notice: Subject to any disclaimer, the term of this patent is extended or adjusted under 35 U.S.C. 154(b) by 27 days.

(21) Appl. No.: 12/408,192

(22) Filed: Mar. 20, 2009

(65) Prior Publication Data

US 2010/0240229 A1 Sep. 23, 2010

(51) Int. Cl.
*H01R 33/00* (2006.01)

(52) U.S. Cl. ..... 439/34; 439/731; 439/906; 439/38; 439/39

(58) Field of Classification Search ..... 439/34, 439/38, 39, 906, 731
See application file for complete search history.

(56) References Cited

U.S. PATENT DOCUMENTS

| | | | | |
|---|---|---|---|---|
| 3,496,500 | A | 2/1970 | Romary | |
| 3,521,216 | A * | 7/1970 | Tolegian | 439/39 |
| 4,317,969 | A | 3/1982 | Riegler et al. | |
| 4,812,133 | A | 3/1989 | Fleak et al. | |
| 5,829,987 | A * | 11/1998 | Fritsch et al. | 439/38 |
| 5,921,783 | A | 7/1999 | Fritsch et al. | |
| 6,183,264 | B1 | 2/2001 | Harsanyi | |
| 6,231,349 | B1 | 5/2001 | Bullinger et al. | |
| 6,273,742 | B1 | 8/2001 | Castagna et al. | |
| 6,561,815 | B1 | 5/2003 | Schmidt | |
| 6,821,126 | B2 | 11/2004 | Neidlein | |
| 6,966,781 | B1 | 11/2005 | Bullinger et al. | |
| 7,097,461 | B2 | 8/2006 | Neidlein | |
| 7,344,380 | B2 | 3/2008 | Neidlein et al. | |
| 7,361,855 | B2 | 4/2008 | Neidlein | |
| 7,364,433 | B2 | 4/2008 | Neidlein | |
| 2007/0149013 | A1 | 6/2007 | Eastham et al. | |

* cited by examiner

*Primary Examiner*—Tho D Ta
*Assistant Examiner*—Travis Chambers
(74) *Attorney, Agent, or Firm*—Ostrolenk Faber LLP

(57) ABSTRACT

An electrical connector for supplying electrical power from a fixed member to a movable member that moves with respect to the fixed member, the movable member bearing an electrical load. The electrical connector has a first connector part fixed to the fixed member and connected to a source of electrical power. A second connector part is fixed to the movable member and is connected to the electrical load. The first connector part and second connector part are movable into electrical engagement when the movable member is moved adjacent the fixed member. The first connector part has a first housing, a movable enclosure in the housing, having first external electrical contacts, and a movable carriage bearing second electrical contacts. The movable carriage has first magnets or magnet attractive components, the second contacts being movable with the carriage by a first magnetic force into electrical engagement with the first contacts.

18 Claims, 16 Drawing Sheets

SLIDING WINDOW MAGNETIC ELECTRICAL CONNECTOR

BACKGROUND OF THE INVENTION

The present invention relates to electrical connectors, and in particular, to a movable window electrical connector for providing electrical power to an electrical load mounted on the movable window, e.g., a sliding window. More particularly, the present invention relates to a sliding window electrical connector for an automotive sliding window defroster. Even more particularly, the present invention relates to such an electrical connector for the sliding rear window of pick-up trucks or other vehicles having a sliding window with an electrical defroster mounted on or in the sliding window. More particularly, the invention relates to such a connector that employs a magnetically operated connection and disconnection mechanism.

Some vehicles, in particular, pick-up trucks and other trucks, often have a sliding center rear window part so that the rear window can be opened. This allows ventilation and also allows long objects to be extended from the bed into the cab of the truck for transportation of the objects. It is desirable to include a rear window defroster element that is powered electrically in the center movable window part. Such electrical defroster elements are commonly used on automotive vehicles, but they have not been used on slidable windows, particularly in trucks such as pick-up trucks, to the inventors' knowledge.

An aim of the invention is to provide a connector for providing electrical power to the defroster in the center movable window part. Further aims of the invention are to provide a reliable connection and a safe connection that ensures that when the window is in the open position, the exposed connector terminals do not carry electrical current which could come into contact with a person or object.

SUMMARY OF THE INVENTION

In order to achieve these and other aims, the invention comprises two connector parts, a stationary connector part mounted on the stationary part of the window and/or its frame and a movable connector part mounted on the movable part of the window and/or its frame. When the movable window is closed, the movable connector part engages with the stationary connector part to provide electrical power to the defroster element on the movable window, e.g., sliding glass. When the sliding glass is opened, the electrical circuit is broken but the exposed terminals on the stationary connector part, which provide the electrical power, are not supplied with electrical power due to a magnetic switching element contained within the stationary connector part.

The movable connector part mounted on the sliding glass or its frame comprises a housing that is fixed to the sliding glass or its frame with, for example, adhesive or adhesive tape or other suitable mounting means and contains at least one electrical contact, and preferably, a pair of contacts, that project outwardly from the housing to make contact with a corresponding electrical contact or contacts on the stationary connector part. At least one magnet or magnet attractive component is arranged on the sliding connector part to provide a magnetic field that extends to the stationary connector part which is mounted on the fixed glass or its frame. The movable connector part has at least one electrical terminal that is connected to the electrical defroster element in the movable window part.

The stationary connector part includes at least one electrical power terminal that is provided with electrical power from the vehicle's electrical system. The stationary connector part has a housing that contains a floating enclosure in which a movable carriage is disposed. The movable carriage includes an electrical connection, e.g., a wire or wires, that connect to the at least one power terminal connected to the vehicle electrical supply and also has at least one electrical contact, and preferably, a pair of electrical contacts. The carriage also includes at least one magnet or magnet attractive component that is disposed in approximate alignment with the at least one magnet or magnet attractive component in the movable connector part when the movable and stationary connector parts are aligned. The magnets or magnet attractive components in the stationary and movable connector parts provide magnetic fields whereby the magnet or magnet attractive components in the stationary and movable connector parts attract each other. There is also at least one external electrical contact, and preferably, a pair of external contacts on the floating enclosure that are disposed in alignment with and are electrically engageable with the at least one contact on the carriage that moves in the floating enclosure. The at least one external contact is also in alignment with the at least one contact of the movable connector part when the movable connector part engages with the stationary connector part when the window is closed.

When the window is closed, the movable connector part comes into engagement with the stationary connector part. As a result, the electrical contact or contacts in the movable connector part come into contact with the external contact or contacts of the stationary connector part. At the same time, the at least one magnet or magnet attractive component in the movable connector part comes into alignment with the corresponding magnet or magnet attractive component in the stationary connector part. The magnets/magnet attractive components attract each other, thus moving the carriage in the floating enclosure toward the movable connector part. This causes the contact or contacts on the carriage, which are connected to the electrical supply, to make electrical connection with the external contact or contacts of the floating enclosure which in turn are in contact with the stationary connector contact or contacts to provide electrical power to the defroster element on the sliding window.

When the window is open, the magnets/magnet attractive components are moved apart and cease to attract each other. A force is provided to retract the carriage in the stationary connector. The force can be provided by a further magnet or magnet attractive component, e.g., a steel plate, which causes the magnet/magnet attractive component held by the carriage to be attracted to the steel plate and thus retract the carriage and its contact or contacts away from the external contact or contacts of the floating enclosure, thereby removing the electrical potential from the external contact or contacts. Thus, when the sliding window is open, there is no possibility of anything coming into contact with the vehicle's live electrical system because the external contacts of the stationary connector part are disconnected from the electrical supply. The vehicles's electrical power source has been disconnected from the stationary connector part's external contacts when the sliding carriage retracts away from the external contacts.

An aspect of the invention is that the enclosure for the movable carriage in the stationary connector part is movable or floats in the stationary connector part housing. This allows limited movement of the enclosure and the external contact or contacts of the stationary connector part so that they can compensate for tolerances in the mounting positions of the stationary and movable connector parts in at least two dimensions. For example, the floating enclosure allows the external contact or contacts to maintain alignment with the contact or contacts of the movable connector part despite manufacturing tolerances, for example, in the glass and frame parts to which the connector parts are mounted.

The invention allows for reliably providing power to the sliding glass rear window defroster and prevents any accidental contact with the vehicles's electrical system power when the window is open and the external contact or contacts of the stationary connector part are exposed.

Other objects, aspects and features of the invention will become apparent from the following detailed description.

BRIEF DESCRIPTION OF THE DRAWING(S)

The invention will now be described in greater detail in the following detailed description with reference to the drawings in which:

FIG. 7C is a sectional view of the sliding connector part along line A-A of FIG. 7D;

FIG. 7D is a plan view of the sliding connector part showing the connector contact surface area;

FIG. 7E shows details of the contact elements of the sliding connector part;

Figure 7A:
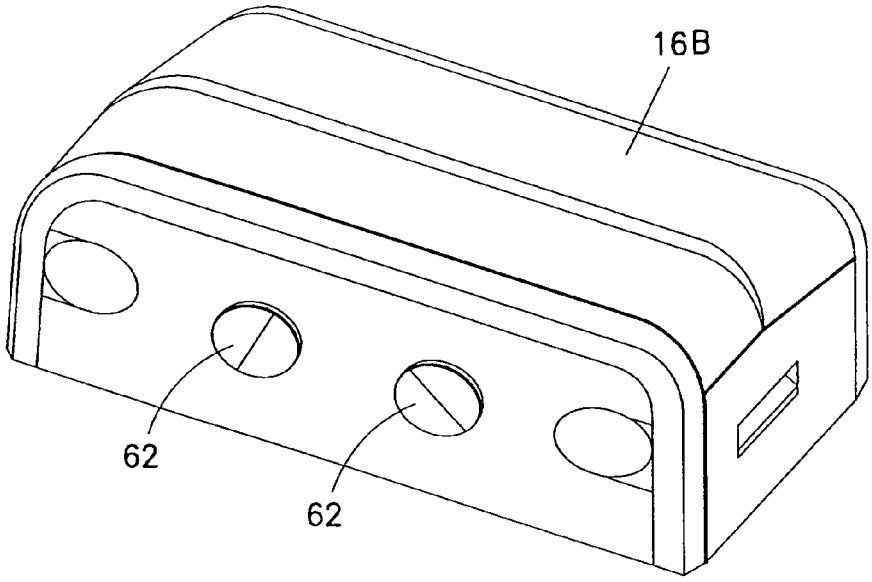
FIG. 7A is a perspective view showing details of the contact surface area of the sliding connector part.
Figure 7B:
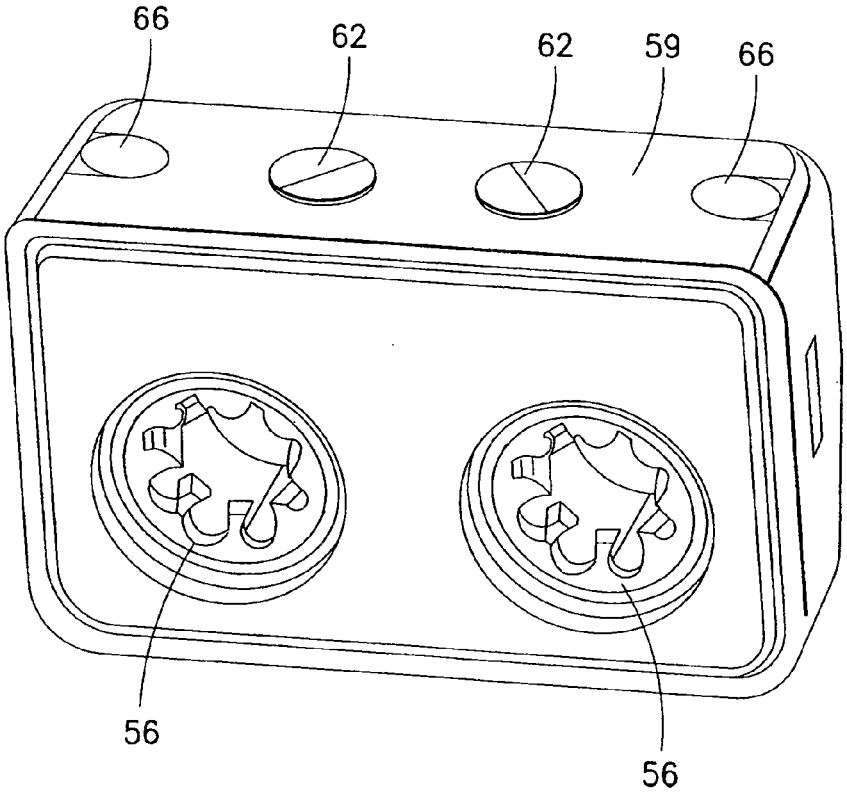
FIG. 7B is a bottom perspective view showing the sliding connector part.
Figure 8:
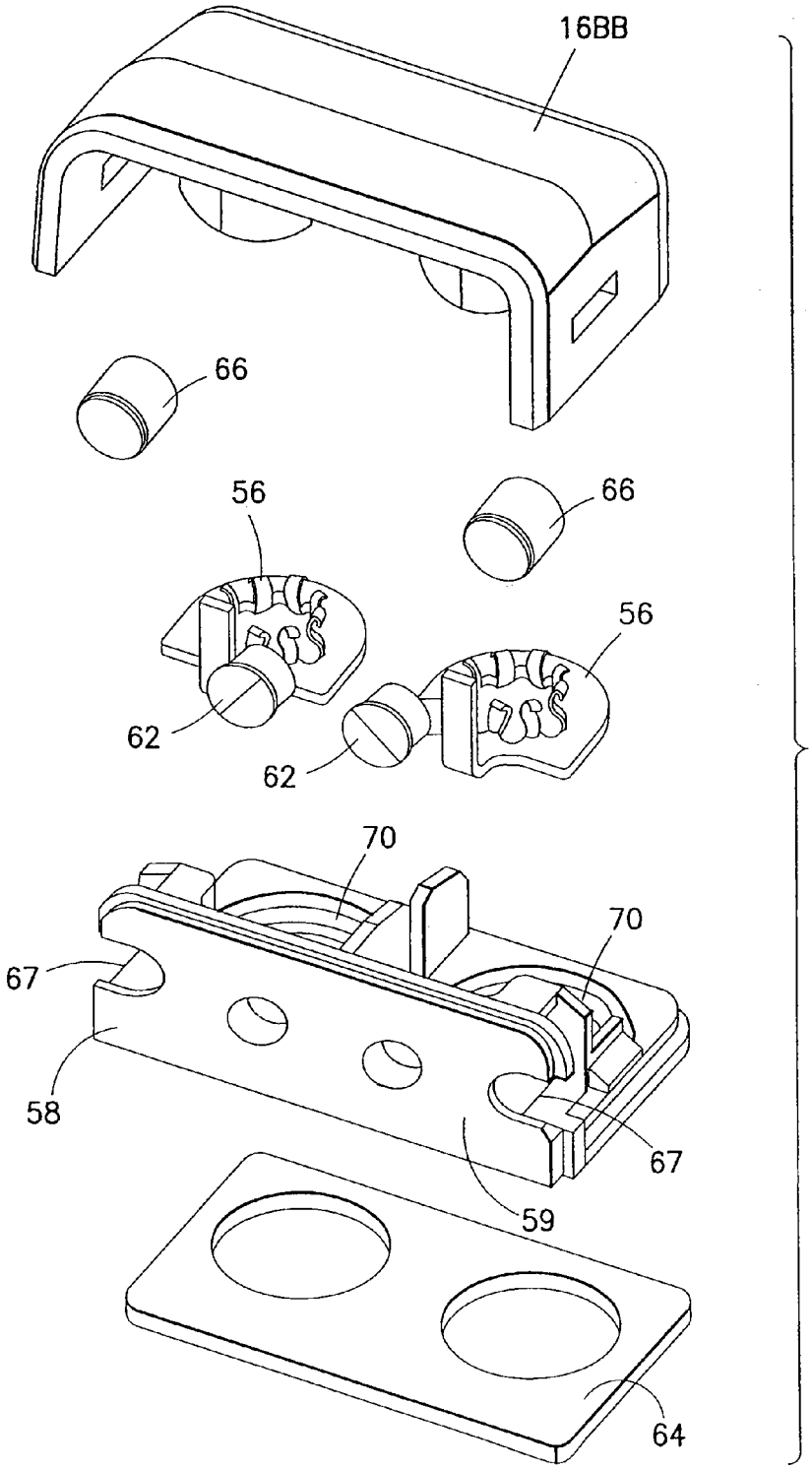
Figure 8A:
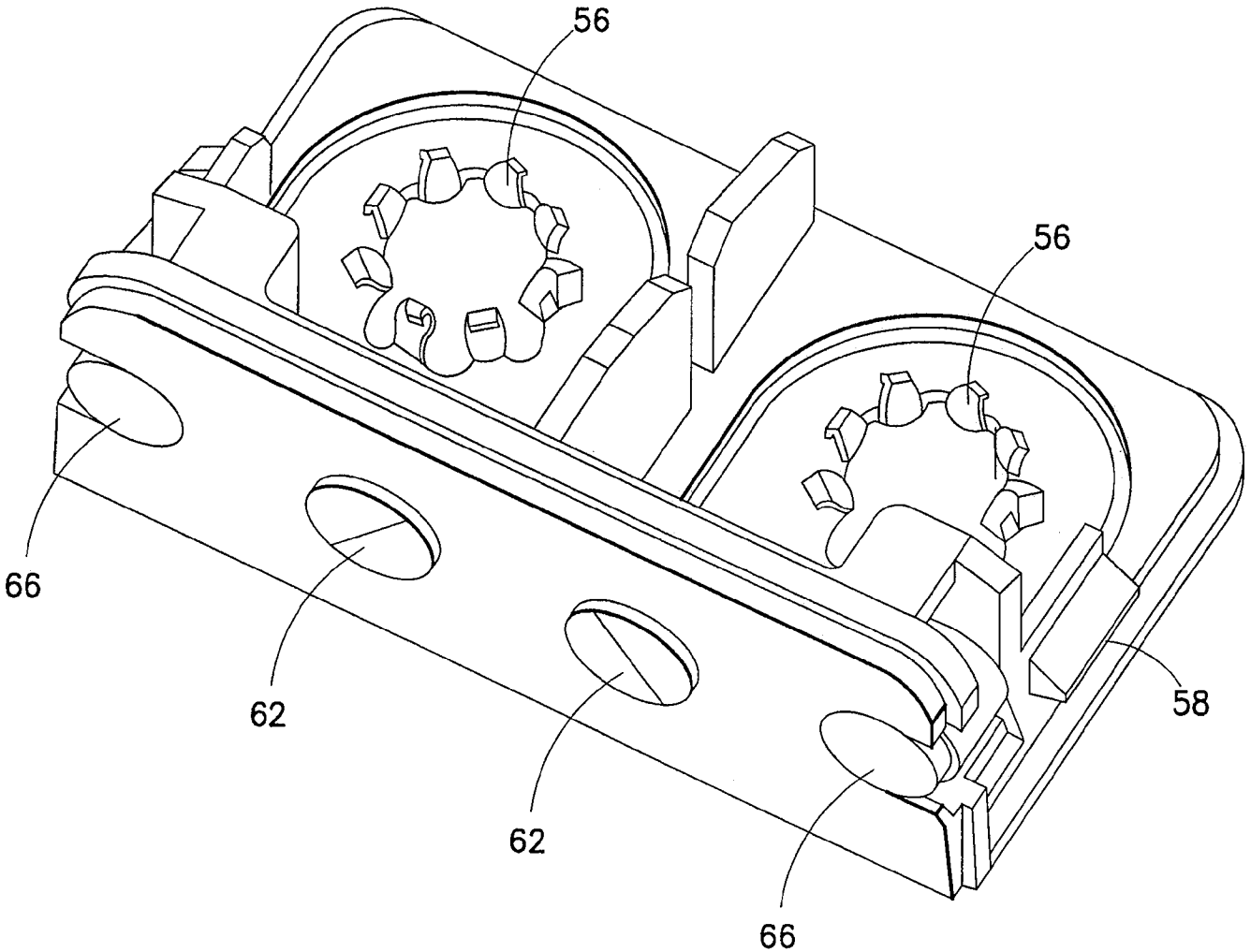
Figure 9A:
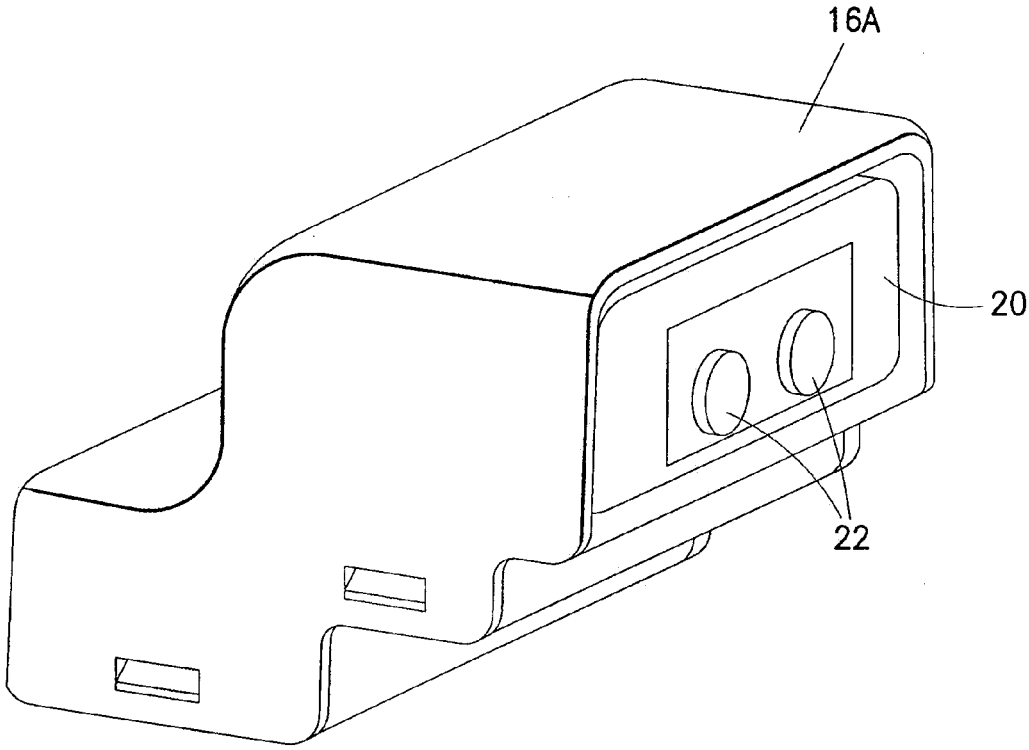
Figure 9B:
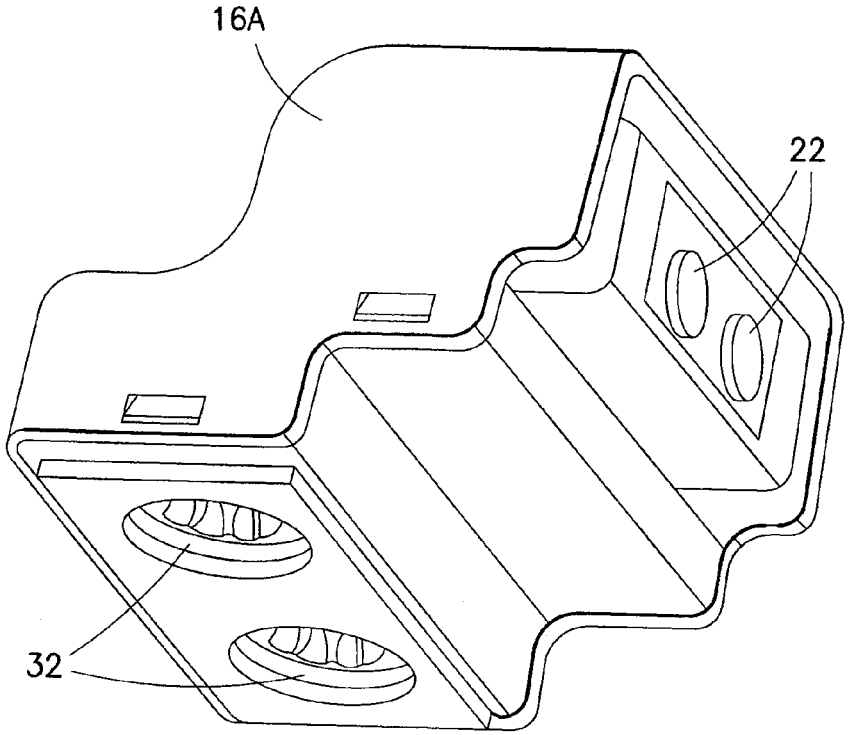
Figure 10:
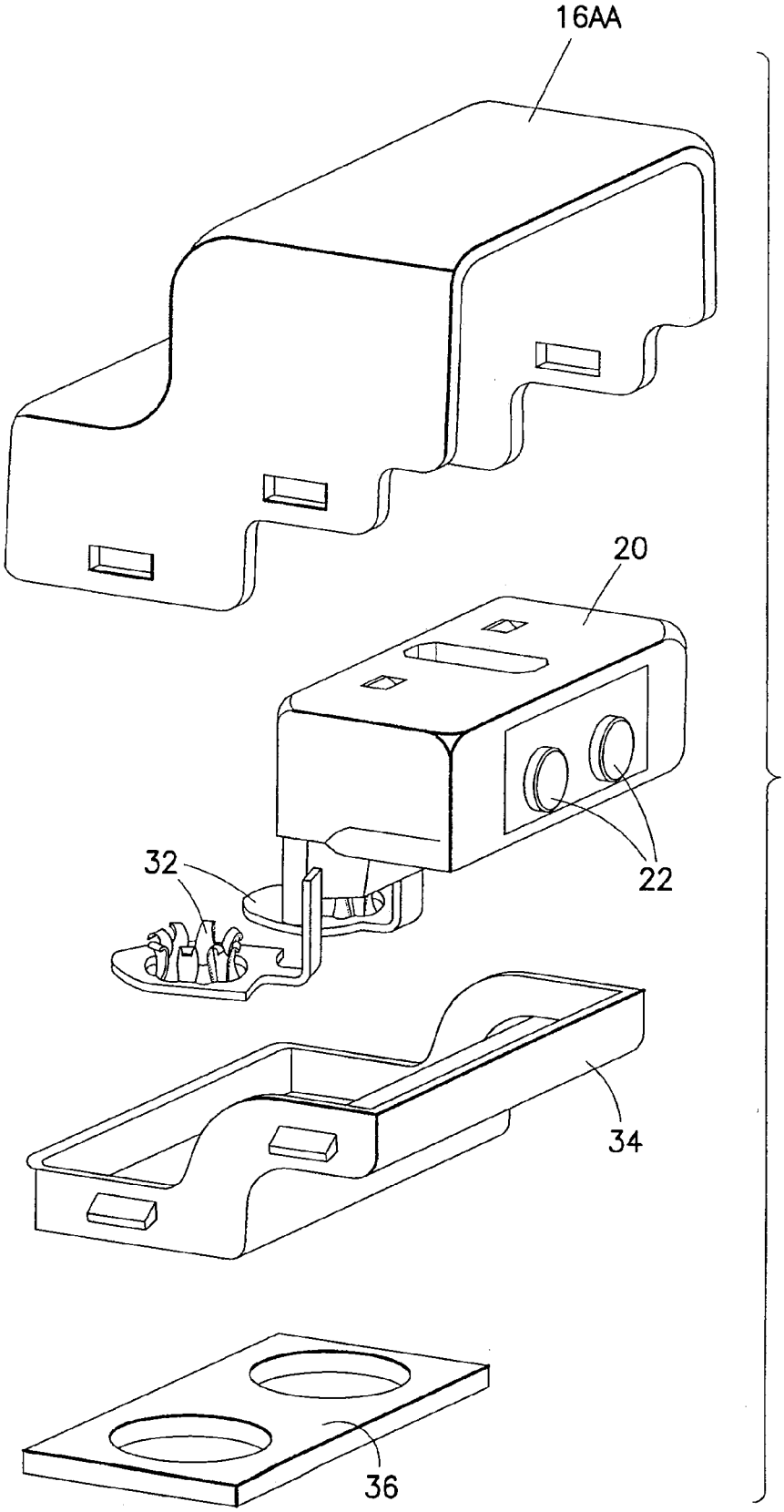
Figure 11:
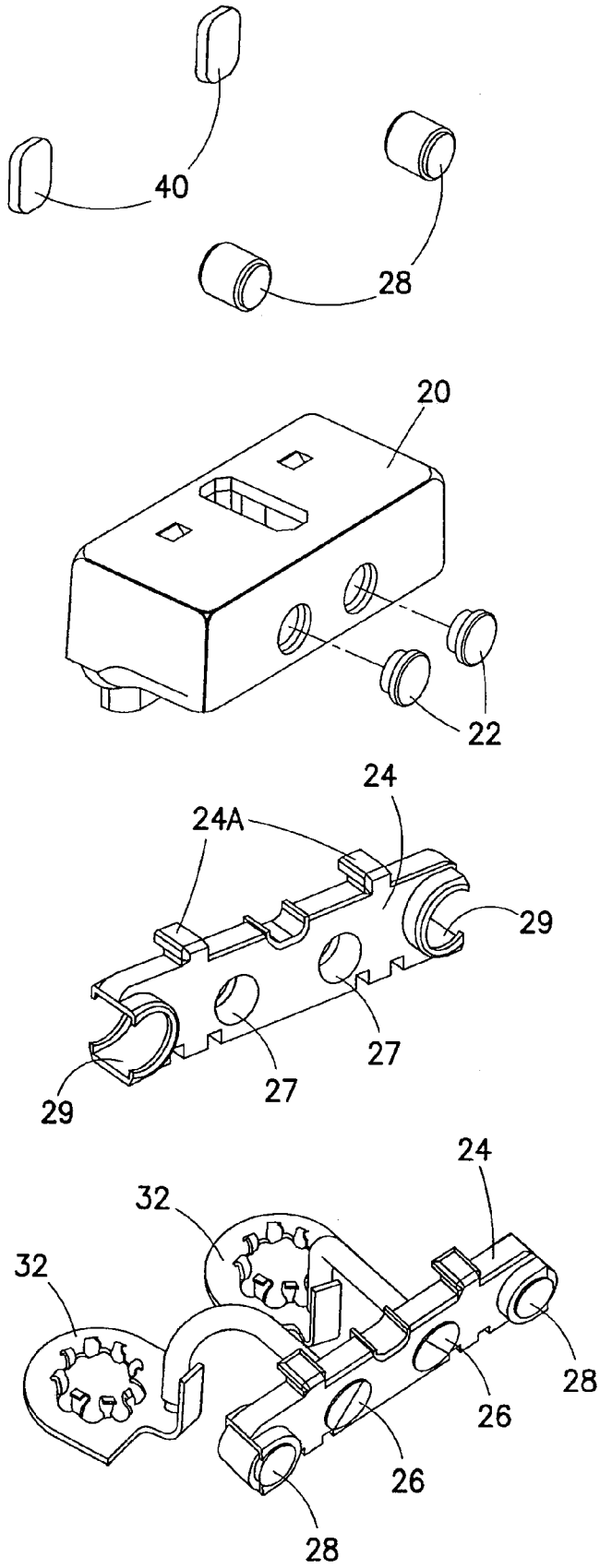
Figure 12:
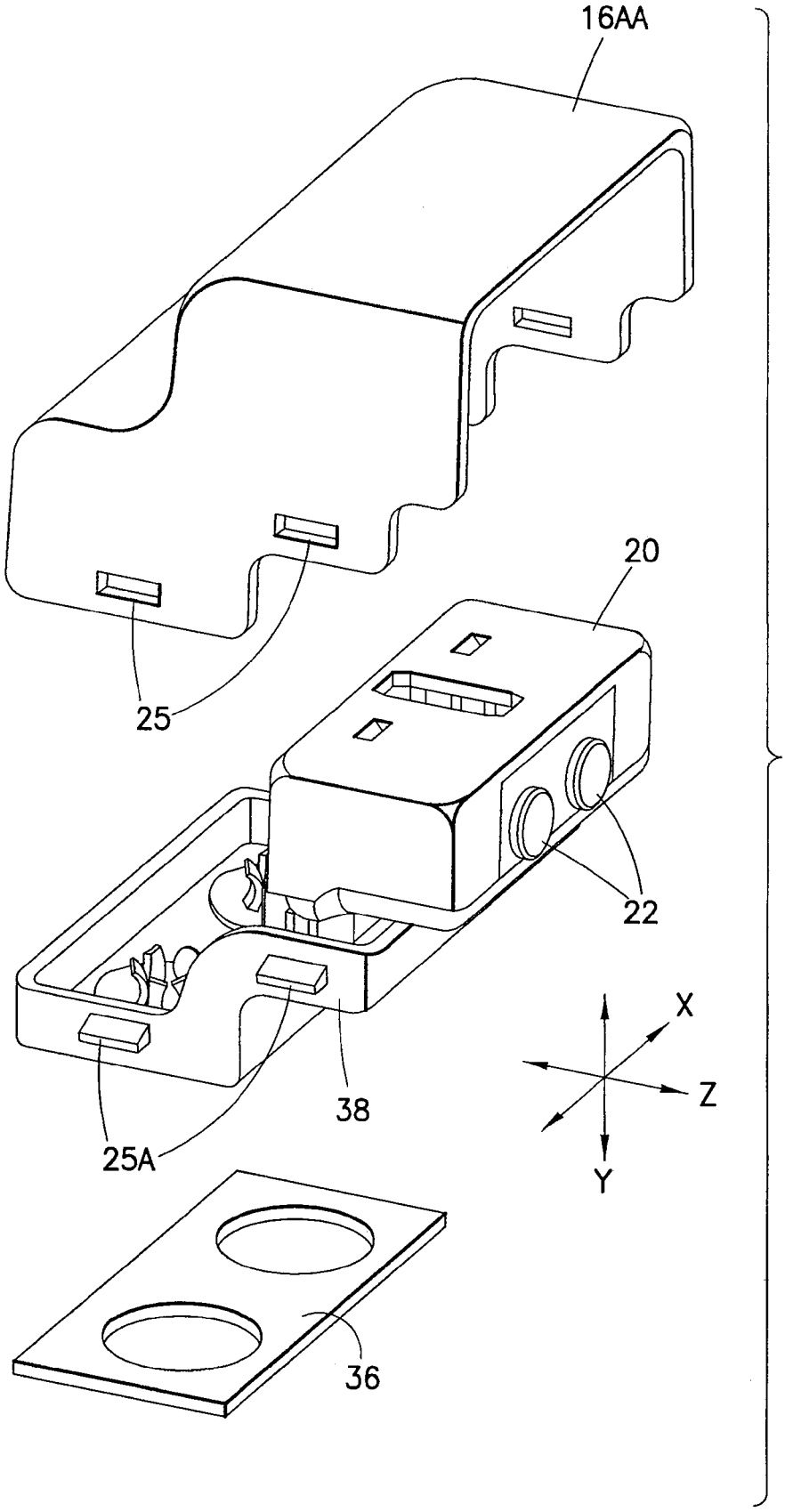
Figure 13:
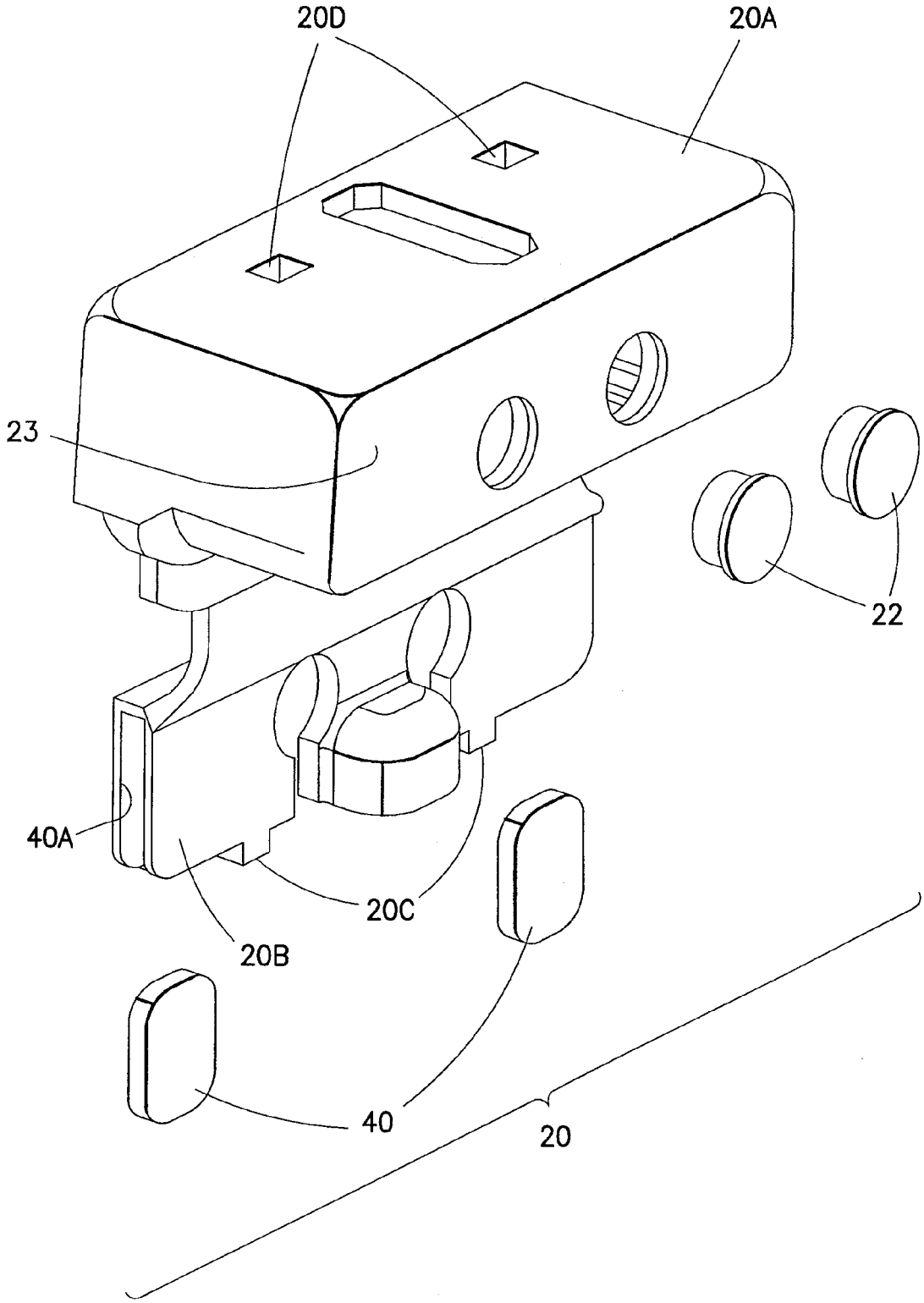
Figure 15:
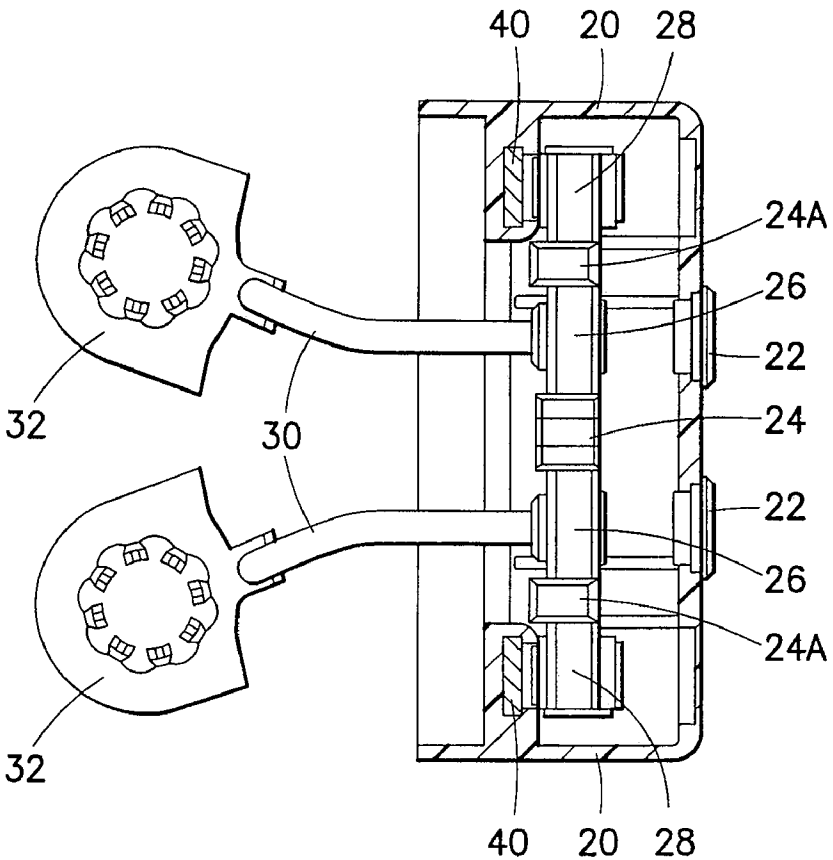
Figure 14:
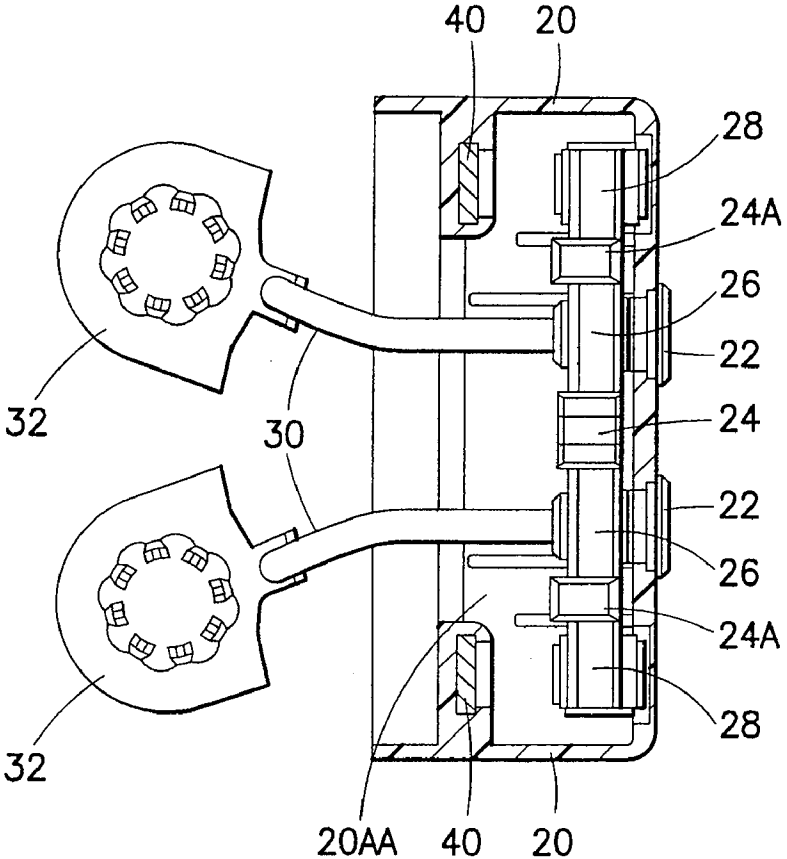
Figure 16:
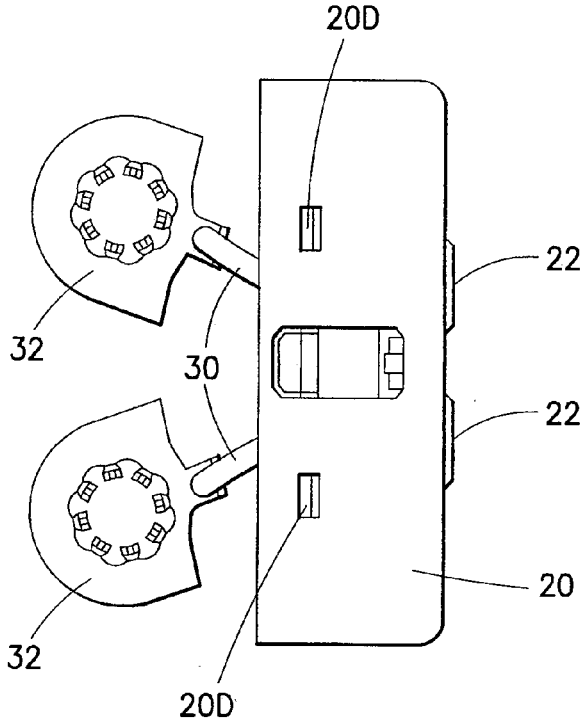
Figure 17:
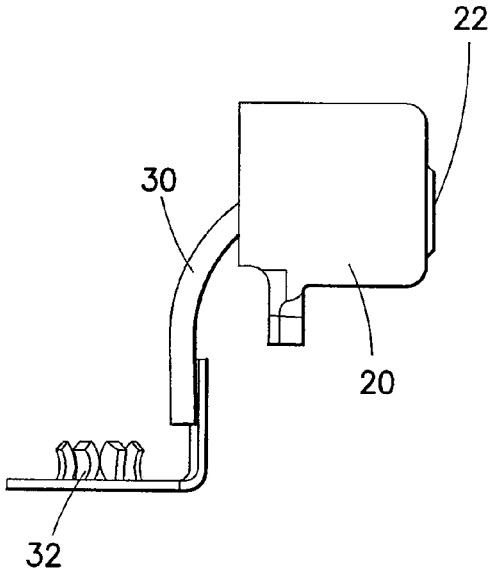
Figure 18:
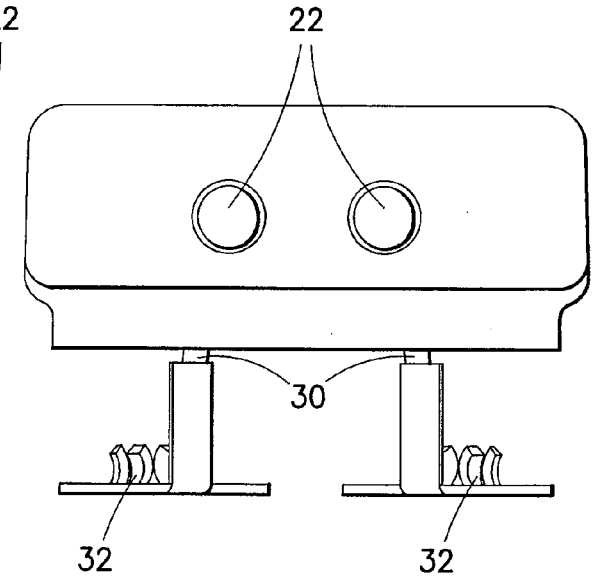
Figure 20:
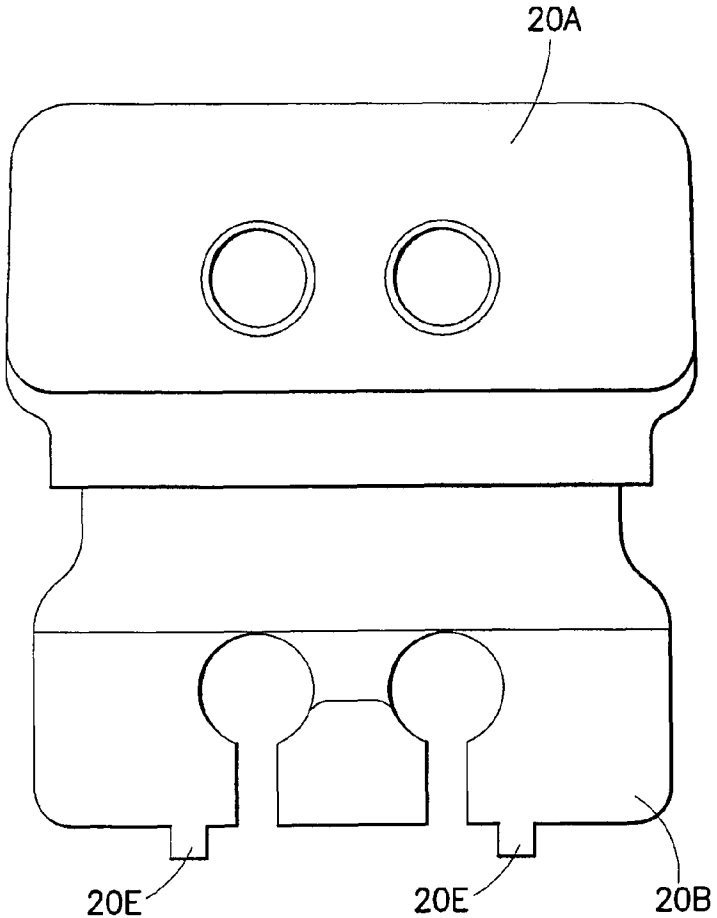
Figure 19:
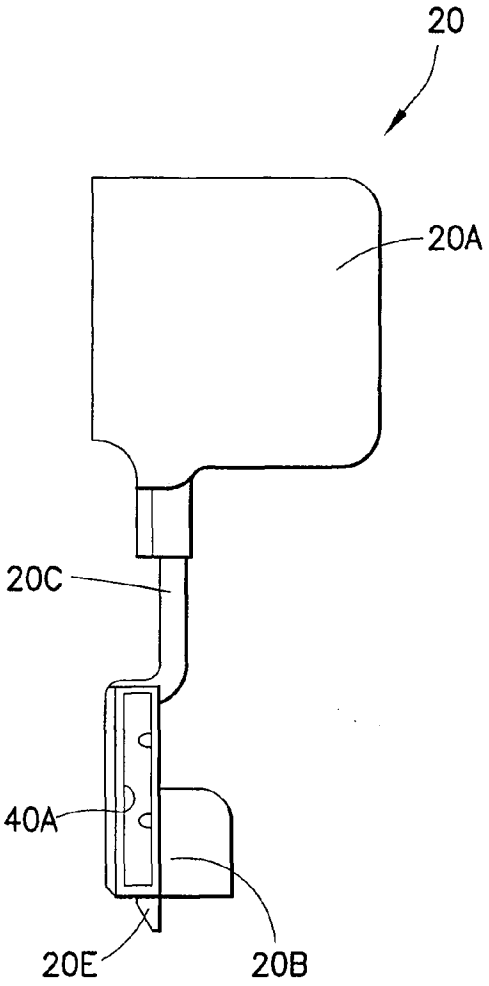

FIG. 7EE shows details of an alternative embodiment of the contact elements of the sliding connector part;

FIG. 8 is a further exploded view of the sliding connector part;

FIG. 8A shows the base of the sliding connector part with the cover removed;

FIGS. 9A and 9B show details of the stationary connector part in two perspective views;

FIG. 10 is a further exploded view of the stationary connector part showing the assembled floating enclosure;

FIG. 11 is a perspective view of the sliding carriage;

FIG. 12 shows the floating enclosure on the base of the stationary connector part with the cover removed;

FIG. 13 shows the floating enclosure and parts in an exploded view prior to complete assembly;

FIG. 14 is a sectional view showing the floating enclosure when the contacts of the floating enclosure are in electrical contact so that electrical power can be provided to the sliding connector part;

FIG. 15 is a sectional view showing the contacts of the floating enclosure in the open position when the window is open so that electrical power is disconnected from its external contacts;

FIG. 16 is a top plan view of the floating enclosure;

FIG. 17 is a side view of the floating enclosure;

FIG. 18 is a front plan view of the floating enclosure showing the contact surface area;

FIG. 19 is a side plan view of the floating enclosure in a partially unassembled condition; and FIG. 20 shows a front plan view of the floating enclosure in its open unassembled condition.

DETAILED DESCRIPTION OF PREFERRED EMBODIMENTS OF THE INVENTION

Figure 1:
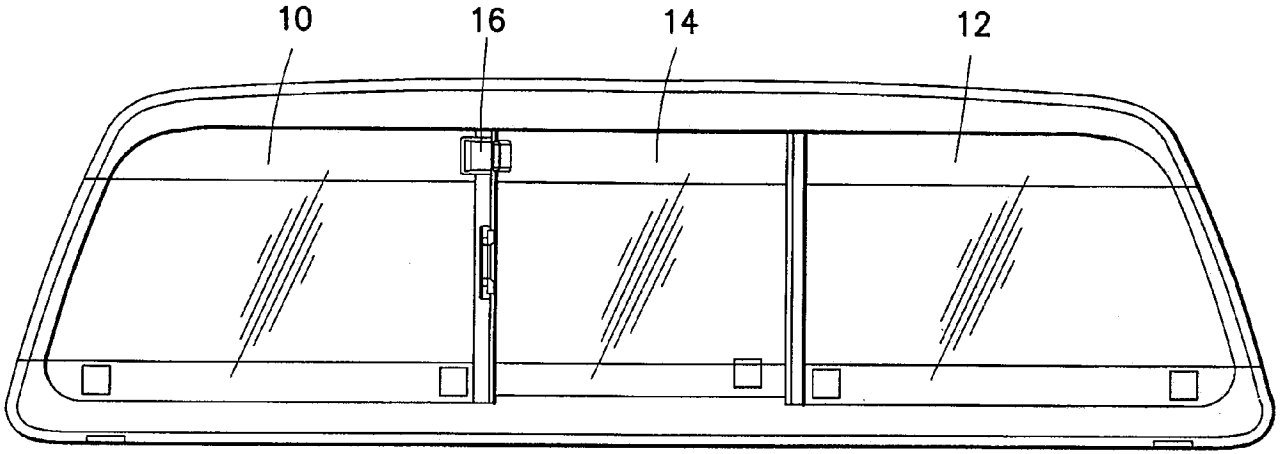
FIG. 1 shows the rear window of, for example, a pick-up truck, showing the center sliding glass with the connector according to the invention installed.

With reference now to the drawings, FIG. 1 shows a rear window for a motor vehicle, in particular, for a pick-up truck. The rear window includes a first stationary portion 10, a second stationary portion 12 and a slidable portion 14. The slidable portion 14 is designed to slide to the right in the example shown in FIG. 1. The portion 14 is adapted to slide in tracks provided at the bottom and top of the frame of the window. Typically, a latch 19 on frame part 18 is provided to open and latch the window closed (FIG. 2).

Figure 2:
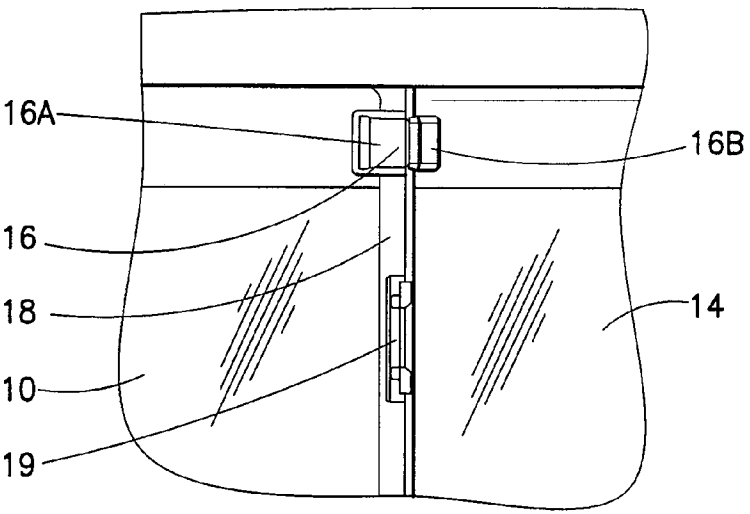
FIG. 2 shows the connector of FIG. 1 in greater detail.

A connector, shown generally at 16, the detail of which is shown in FIG. 2, is provided according to the invention. The connector includes a stationary part 16A and a slidable connector part 16B. The stationary part 16A is mounted to the glass 10 and/or the stationary glass frame, or both. The slidable connector part 16B is mounted to the slidable glass portion 14 or its frame, or both. The parts 16A and 16B can be mounted using an adhesive or double sided adhesive tape. A suitable electrical defroster element (not shown) is contained integrally in the glass portion 14 or mounted to the glass portion 14 as an applied electrical heating element. Such heating elements are known.

Figure 4:
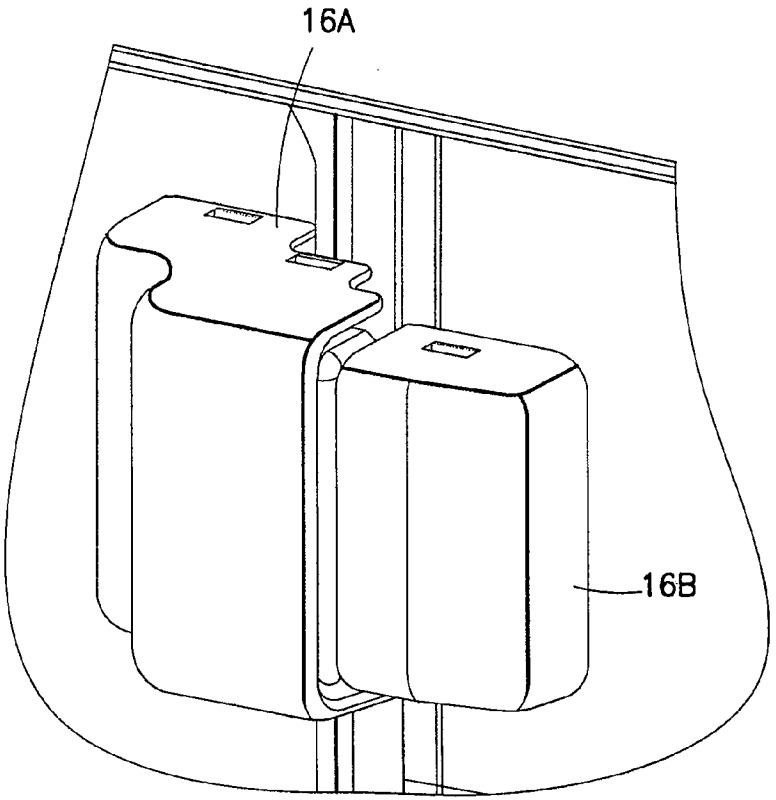
FIGS. 3 and 4 are different perspective views of the installed connector in yet greater detail.
Figure 3:
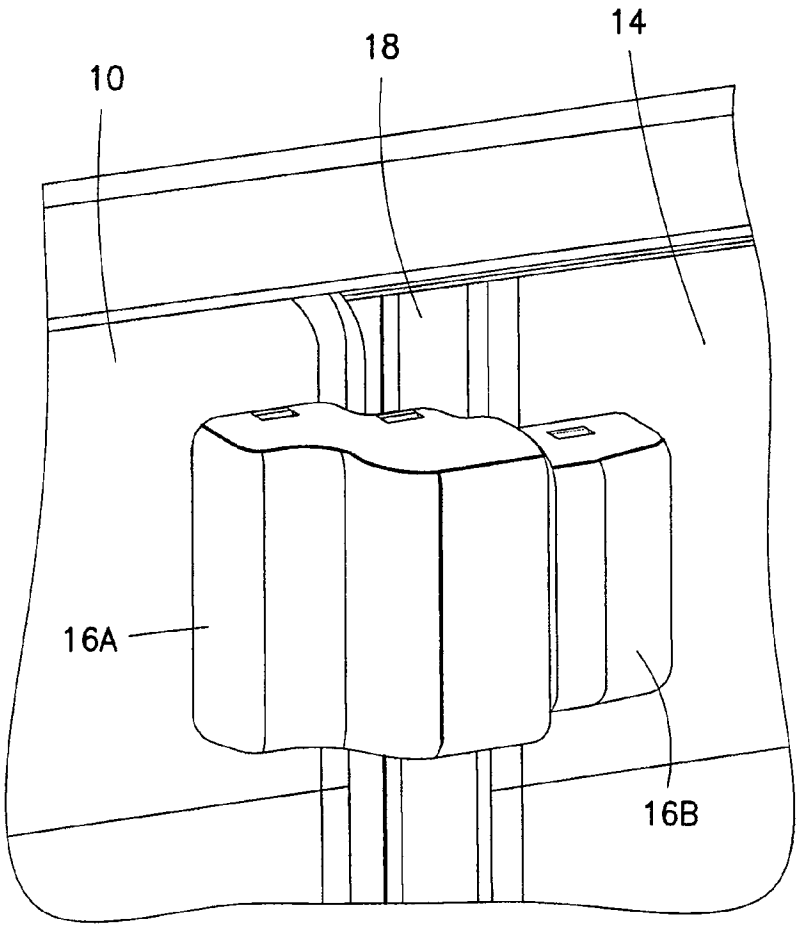

FIGS. 3 and 4 show perspective views of the mounted connector comprising connector portion 16A and 16B in greater detail.

Figure 5A:
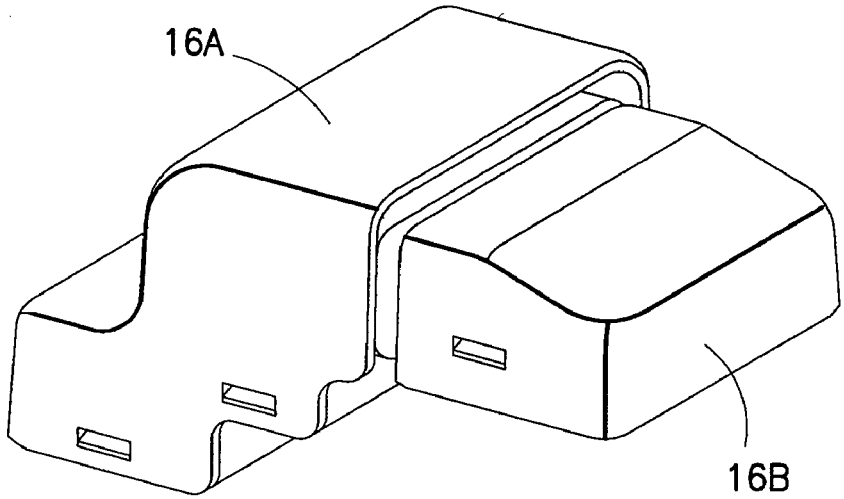
FIG. 5A is a perspective view of the connector in the window closed position.
Figure 5B:
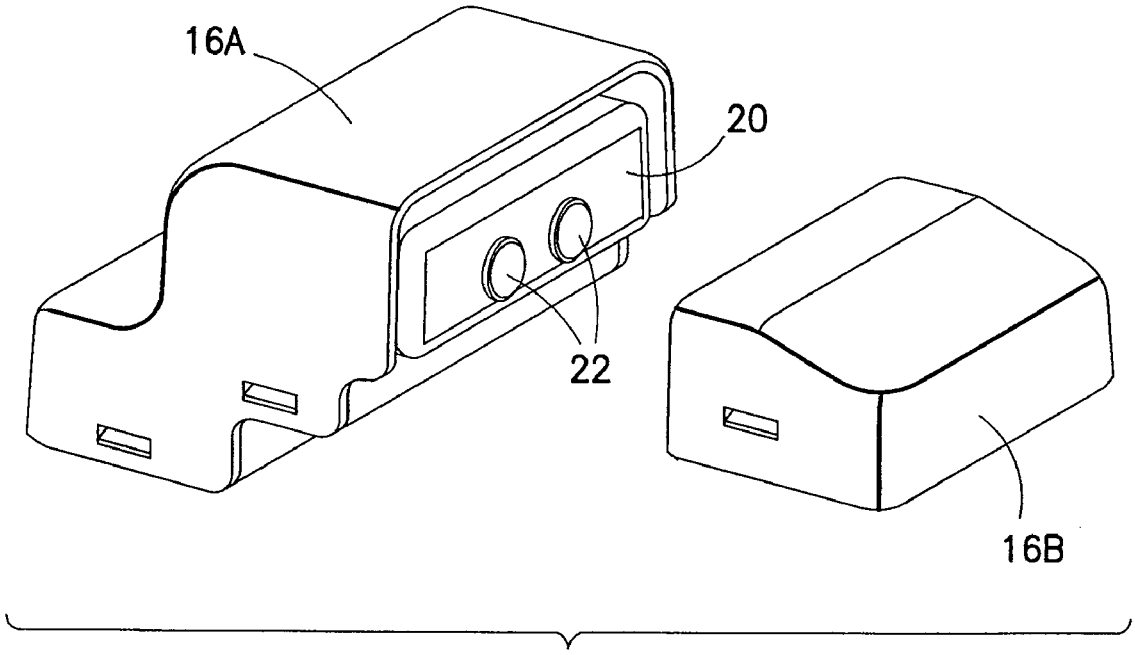
FIG. 5B shows the connector in the window open position.

FIGS. 5A and 5B show the connector, respectively, in the window closed position and in the window open position.

Figure 6:
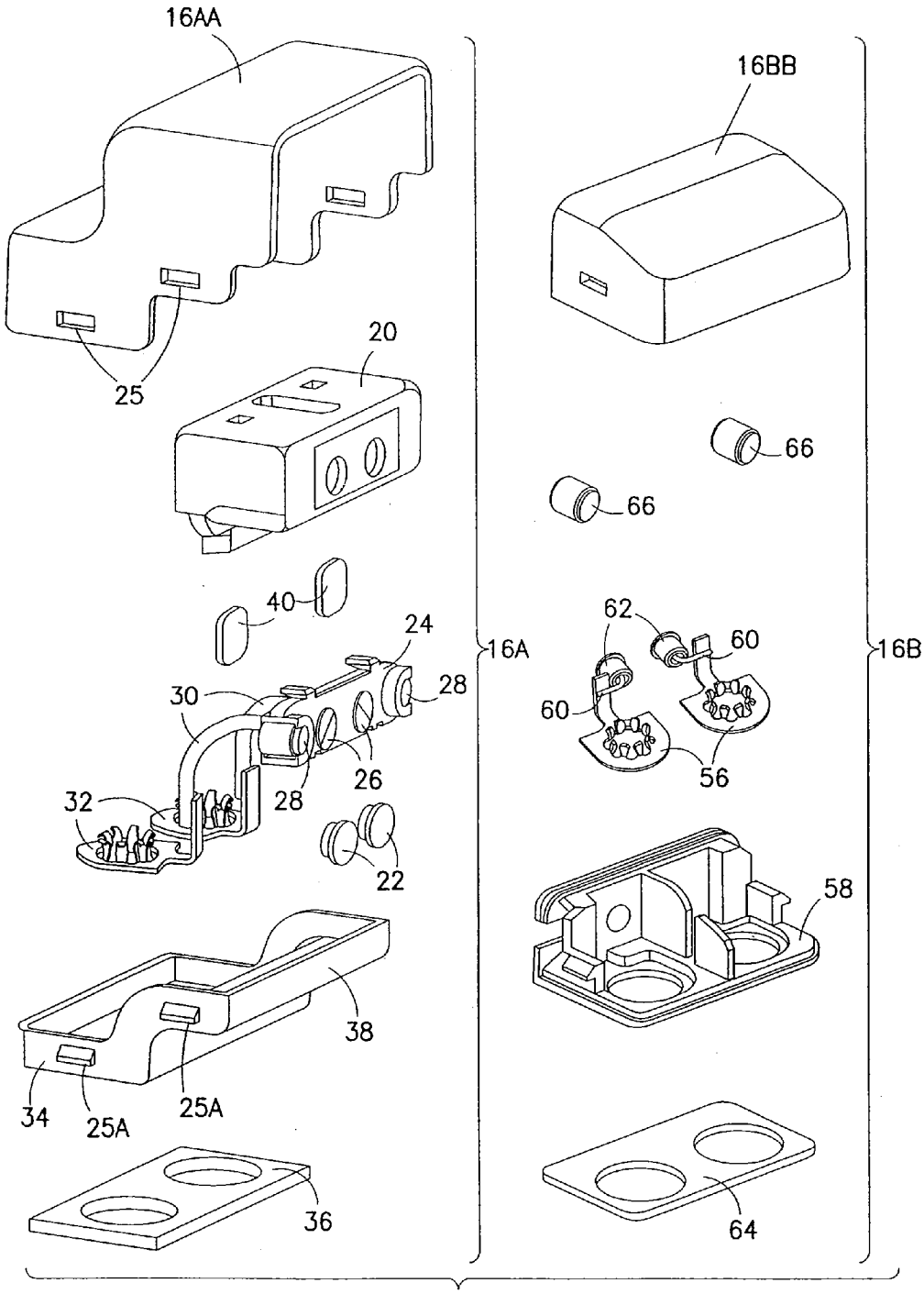
FIG. 6 is an exploded perspective view of the stationary and sliding connector parts that form the connector according to the present invention.

FIG. 6 is an exploded view of the two parts 16A and 16B of the connector.

The stationary connector part 16A includes an electrically insulated housing 16AA which may be formed of a suitable plastic, although other materials can be used. Inside the housing, an electrically insulated floating enclosure 20, also preferably of plastic and which preferably contains two sets of contacts, is disposed. Alternatively, the enclosure can contain only a single set of contacts, in which case only one side of the electrical supply is switched. In such case, the unswitched electrical return can be made via the sliding window channel and chassis ground, although this is not preferred.

The floating enclosure 20 includes a set of external contacts 22 which are mounted on the face of the floating enclosure. Inside the floating enclosure 20, a beam-like electrically insulated carriage 24 that is movable, e.g., slidably, in the enclosure 20, is disposed. The carriage 24 has contacts 26 mounted in openings 27 and preferably two magnets 28. See also FIG. 11. Alternatively, a single magnet could be used.

Instead of magnets 28, magnet attractive components can also be used, i.e., ferromagnetic components, with the magnets being disposed in the sliding connector part 16B (or one magnet and one magnet attractive part in each connector part). The contacts 26 are arranged to make contact with the two external contacts 22 that are mounted to the front face of the floating enclosure 20. The contacts 26 on the carriage are connected to wire leads 30 which terminate in terminals 32 that are adapted to be connected to the vehicle's electrical power source. The terminals 32 are fixed to the base 34, which is in turn mounted to the stationary glass 10 and or its frame by double sided adhesive tape 36 or other suitable mounting means. The base 34 is suitably formed at 38 so that it overlies the window frame 18 as shown in FIGS. 3 and 4.

Housing 16AA has slots 25 that receive projections 25A of base 34 with a snap fit to mount the housing to the base.

Also provided in pockets in the floating enclosure 20 are two steel retraction plates 40, which are provided to retract the sliding carriage 24 by magnetic attraction of the magnets 28, away from the contacts 22 when the slidable window portion 14 is open and the slidable connector part 16B is not positioned adjacent the stationary connector part 16A. As should be clear to one of skill in the art, plates 40 could be magnets instead of magnet attractive plates. Alternatively, the retraction force could be provided by a difference device, e.g., a return spring or springs. Whatever is used to provide the retractive force, it must be arranged so that the retractive force is overcome by the magnetic attractive force that moves the carriage 24 into engagement with contacts 22 when the connector parts 16A and 16B are in the window closed position.

With reference to FIG. 11, the slidable carriage 24 is shown in greater detail. The magnets 28 are provided in recesses 29 in the slidable carriage 24. The contacts 26 are mounted in openings 27 provided in the carriage 24.

As shown in FIG. 13, the floating enclosure 20 is preferably molded as a single unit from suitable plastic with two integral portions 20A and 20B. The portions 20A and 20B are connected by a foldable hinge 20C as shown in FIG. 19. The hinge is a molded in as living hinge. FIGS. 13 and 19 show the floating enclosure 20 in its as molded condition. The external contacts 22 are mounted in openings 23 in the front surface of the floating enclosure 20, and the carriage 24 together with its contacts 26 and magnets 28 are assembled into the portion 20A for sliding movement.

The enclosure 20 is preferably provided internally with slots 20AA that receive bosses 24A to maintain sliding alignment. See FIG. 14. The steel retracting plates 40 are disposed in pockets 40A in the portion 20B. Once all components are assembled into the enclosure 20, the portion 20B is folded on its hinge 20C into the back of the portion 20A via a snap fit of projections 20E into recesses 20D, thereby forming the assembled floating enclosure 20 with its attached wires 30 and terminals 32. A side plan view of the floating enclosure is shown in FIG. 17.

As shown in the front plan view of FIG. 18, the contacts 22 of the floating enclosure 20 may project slightly to facilitate alignment with the slidable connector part 16B and to assure reliable electrical contact.

Turning again to FIG. 6, the slidable connector part 16B is shown adjacent the stationary connector part 16A in an exploded view. The slidable connector part 16B includes an electrically insulated housing 16BB, for example, made of plastic or other suitable material, an insulating base 58 also preferably of plastic, and two terminals 56 which are mounted to the base 58 and include wires 60 connecting contacts 62 to their respective terminals 56. The terminals 56 are adapted to be connected to the defroster element that is powered through electrical engagement of the contacts 62 with the contacts 22 of the stationary connector part. The base 58 is mounted to the sliding glass by any suitable means, for example, double sided adhesive tape 64 or other suitable means, for example, an adhesive. Also mounted to the base 58 in openings provided in the base 58 are two magnets 66. The magnets 66 are polarized such that their fields cause an attractive force with the magnets 28 of the stationary connector part.

As previously described, a single electrical contact 62 could be provided if only one side of the electrical supply is switched. Also, a single magnet 66 could be used. Further, magnets 66 can instead be magnet attractive components (i.e., ferromagnetic) if magnets 28 are provided in the stationary connector part 16A. Alternatively components 66 can be magnets and components 28 can be magnet attractive.

Although various arrangements of the components 66, 28 and 40 can be used, in a preferred implementation, components 66 and 28 are magnets and components 40 are steel plates. Corresponding magnets 66 and 28 are polarized such that their fields attract, i.e., the north pole of a magnet 28 can be arranged opposite the south pole of a magnet 66, or vice versa. In this way, a strong magnetic attraction is provided when the window is closed and slidable connector part 16B is disposed adjacent connector part 16A. This causes the sliding carriage 24 to be attracted toward the magnets 66 in the slidable connector part 16B, overcoming the force of attraction provided by the interaction between retraction plates 40 and magnets 28.

FIG. 8 shows the slidable connector part in greater detail in an exploded view. Magnets 66 are disposed in recesses 67 in the base 58. Terminals 56 are mounted to the base 58 so that they are accessible through openings 70 in the base 58 for connection to the defroster element.

Turning now to FIGS. 14 and 15, the operation of the connector will now be described.

FIG. 14 shows the carriage 24 inside the floating enclosure 20 when the window is in the closed position, i.e., the connector parts 16A and 16B are aligned next to each other as shown in FIG. 5A. In this case, the magnets 66 of the slidable connector part 16B are disposed adjacent the stationary connector part 16A. As a result, the magnets 66 of the slidable connector part attract the magnets 28 on the slidable carriage 24 of the stationary connector part. The carriage 24 is thus moved toward the magnets 66 into the position shown in FIG. 14. As a result, the contacts 22 mechanically and electrically engage with the contacts 26 on the carriage 24. Thus, contacts 22 are connected to the vehicle's electrical supply via the terminals 32, wires 30 and movable contacts 26 on the slidable carriage 24. Since the slidable connector part 16B is engaged with the stationary connector part 16A, its contacts 62 are electrically and mechanically engaged with the contacts 22, thereby completing the circuit through the wires 60 and terminals 56 to the electrically connected defroster element mounted on or in the movable glass portion 14. Thus, electrical power is provided to the defroster element.

When the window is opened (FIG. 5B), the defroster element is disconnected from the vehicle's electrical power source because the contacts 62 are no longer connected to contacts 22. Further, magnets 66 move away from the magnets 28. As a result, the attractive force is reduced or removed and magnets 28 are attracted to the plates 40 disposed in the housing 20, retracting the carriage 24 with its contacts 26 from electrical and mechanical engagement with the contacts 22. This is shown in FIG. 15. Accordingly, contacts 22 are no longer connected to the vehicle's electric power circuit and there is no possibility of any object, person or thing accidentally coming into contact with the vehicle electrical supply when the window is open and the contacts 22 are exposed. Thus, the present invention provides safety from a person or object accidentally coming into contact with the vehicle electrical power source when the window is open.

Since the enclosure 20 floats with a limited degree of movement between the base 38 and housing 16AA of the stationary connector part, and thus has a limited degree of movement in the directions x and y as shown in FIG. 12 (and also in the Z direction), alignment of the contacts 22 of the floating enclosure with the contacts 62 of the slidable connector part 16B, despite manufacturing tolerances in the glass and frame of the window, is assured. To assist in alignment, contacts 22 project outwardly slightly from the contact face of floating enclosure 20 so that they are received by contacts 62 of slidable connector part 16B, which may be slightly recessed. Further, mating projections and depressions may be provided in the contact faces to assist in alignment although these should not be necessary as magnets are self centering. In addition, a recess may be provided in the front surface of the slidable connector part. This recess is adapted to receive a projection that can be provided on the face of floating enclosure 20. The purpose of this projection is to provide additional safety. In case the switch provided by the carriage 24 fails to retract when the window is open and the contacts 22 are still electrically connected to the vehicle electrical supply, the projection serves as a safety device so that a flat piece of metal can not be placed on the face 23 and short out the terminals 22 which could possibly cause harm to a person or object.

Figure 5C:
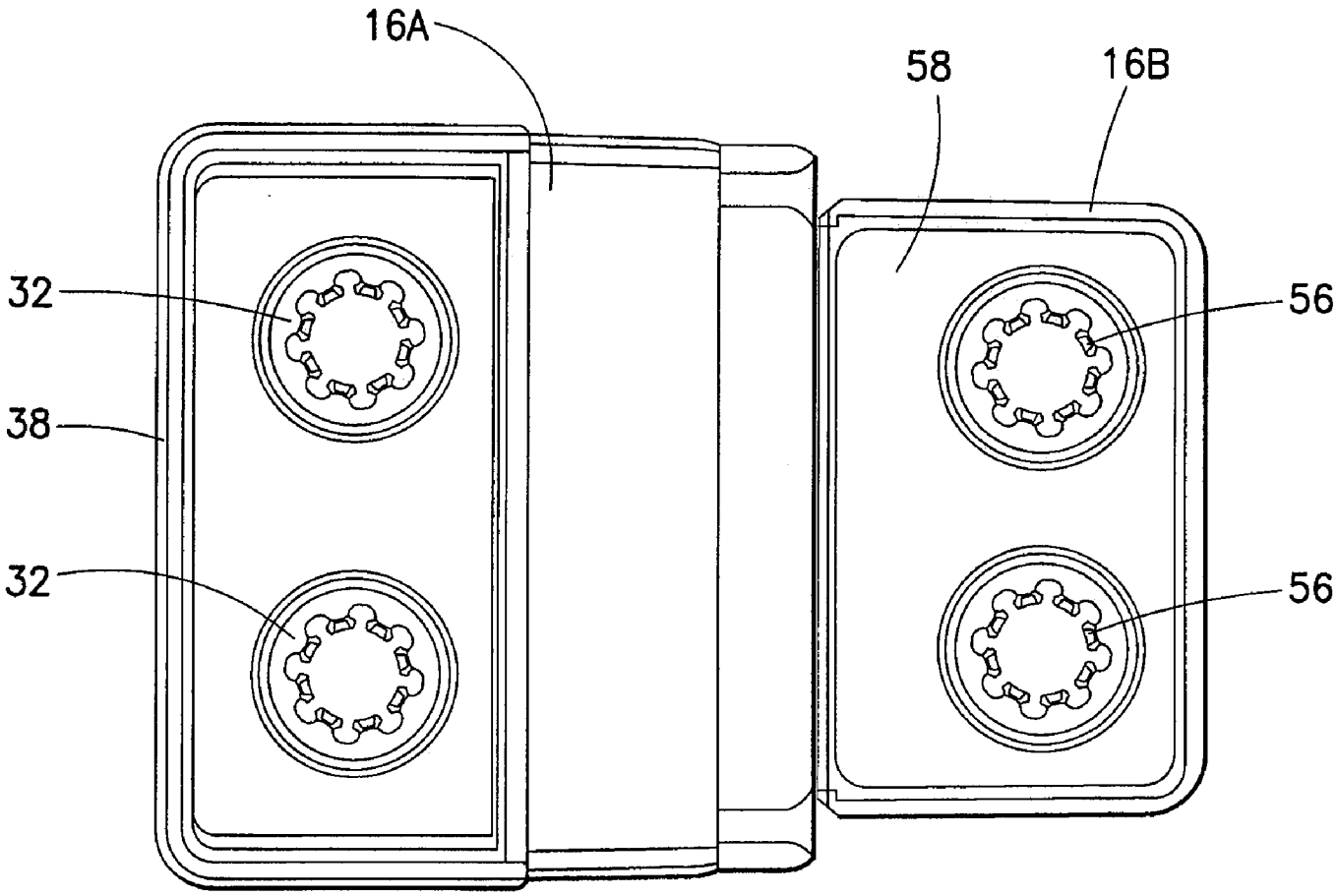
FIG. 5C shows a bottom view of the stationary and sliding connector parts in the closed position.

FIG. 5C shows the bottom view of the two connector parts 16A and 16B. FIG. 7E shows terminals 56 and the contacts 62. A sectional view of sliding connector part 16B is shown in FIG. 7C. FIG. 7D shows a front plan view of the sliding connector portion 16B.

FIG. 7EE shows an alternative embodiment of the contacts of the slidable connector part. As shown, the contacts 62' are provided with springs 63 to bias them outwardly to ensure electrical contact with contacts 22 of the stationary connector part. Further, contacts 62 can project outwardly from the surface 59 of the slidable connector part and contacts 22 of the stationary connector part may be recessed.

There has thus been described an electrical connector which allows electrical current to be supplied safely and reliably to a movable window portion for providing power to a defroster element mounted integrally or on the movable window portion surface. When the movable window is opened, the electrical power is both removed from the defroster element and the exposed contacts of the stationary powered connector part are disconnected from the vehicle electrical power source.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An electrical connector for supplying electrical power from a fixed member to a movable member that moves with respect to the fixed member, the movable member bearing an electrical load, the electrical connector comprising:

a first connector part fixed to the fixed member and having at least one first electrical connection for connecting to a source of electrical power;

a second connector part fixed to the movable member and having at least one second electrical connection for connecting to the electrical load;

the first connector part and second connector part being movable into electrical engagement when the movable member is moved adjacent the fixed member thereby to supply electrical power from the first connector part to the second connector part and to the electrical load and being movable out of electrical engagement when the movable member is moved away from the fixed member, thereby to remove electrical power from the electrical load;

the first connector part comprising a first housing, a movable enclosure in said housing, said enclosure having a first surface, the first surface bearing at least one first electrical contact, further comprising a movable carriage in said movable enclosure, said movable carriage bearing at least one second electrical contact, said movable carriage bearing at least one first magnet or magnet attractive component, said at least one second contact being movable with said carriage by a first magnetic force into electrical engagement with said at least one first electrical contact and being retracted away from said at least one first electrical contact by a second force, said at least one second electrical contact being electrically connected to said at least one first electrical connection;

said second connector part comprising a second housing and at least one second magnet or magnet attractive component and having a second surface that is adapted to be disposed adjacent said first surface when said first and second connector parts are disposed adjacent each other, said second surface bearing at least one third electrical contact for electrically engaging with said at least one first electrical contact when said first and second connector parts are disposed adjacent each other, said at least one third electrical contact being electrically connected to said at least one second electrical connection, whereby said first magnetic force is generated when said first and second connector parts are disposed adjacent each other by the interaction of said at least one first magnet or magnet attractive component and said at least one second magnet or magnetic attractive component thereby to move said movable carriage to allow said at least one first and second electrical contacts to come into electrical engagement;

further wherein, when said second connector part is moved away from said first connector part, said first magnetic force is reduced or ceases to act on said movable carriage and said movable carriage is retracted by said second force away from said at least one first electrical contact whereby the at least one first electrical contact is electrically disengaged from said at least one second electrical contact and said at least one first electrical contact is disconnected from said source of electrical power; and said movable enclosure bearing said at least one first electrical contact having a limited range of motion in at least two directions defining said first surface thereby to facilitate alignment of said at least one first electrical contact and said at least one third electrical contact.

2. The electrical connector of claim 1, wherein said at least one third electrical contact comprises at least one projecting spring loaded contact for electrical engagement with said at least one first electrical contact.

3. The electrical connector of claim 1, wherein said at least one second electrical contact is electrically connected to said at least one first electrical connection by a wire and said at least one third electrical contact is connected to said at least one second electrical connection by a wire.

4. The electrical connector of claim 1, wherein said first and second connector parts are fixed, respectively, to the fixed member and movable member by an adhesive component.

5. The electrical connector of claim 1, wherein the movable enclosure comprises a box-like member having an opening opposed to the first surface, a closing element being integrally attached to the box-like member by an integral hinge, whereby the closing element can be pivoted on said hinge to close off said opening.

6. The electrical connector of claim 1, wherein the fixed member is a stationary window part and the movable member is a slidable window part and the electrical load is a defroster element borne by the slidable window part.

7. The electrical connector of claim 1, wherein the floating enclosure has a limited range of motion in a direction perpendicular to said two directions.

8. The electrical connector of claim 1, wherein the at least one first electrical contact, the at least one second electrical contact and the at least one third electrical contact each comprise a pair of electrical contacts.

9. The electrical connector of claim 8, further comprising a safety projection on said first surface for reducing the likelihood that an electrically conductive object will simultaneously come into contact with the pair of electrical contacts comprising said at least one first electrical contact, and further comprising a corresponding recess on said second surface for receiving said safety projection.

10. The electrical connector of claim 8, wherein said movable carriage comprises a beam-like element having a pair of contacts comprising said at least one second electrical contact and disposed for slidable movement in said movable enclosure.

11. The electrical connector of claim 8, wherein the at least one first magnet or magnet attractive component and the at least one second magnet or magnet attractive component comprise magnets arranged to generate an attractive first magnetic force when said first and second connector parts are disposed adjacent each other.

12. The electrical connector of claim 11, wherein said at least one first magnet or magnet attractive component and said at least one second magnet or magnet attractive component each comprise a pair of magnets.

13. The electrical connector of claim 11, wherein the second force comprises a second magnetic force generated by the interaction of said first magnet or magnet attractive component and at least one third magnet or magnet attractive component.

14. The electrical connector of claim 13, wherein the third magnet or magnet attractive component comprises a magnet attractive metal object in said movable enclosure.

15. The electrical connector of claim 14, wherein the third magnet or magnet attractive component comprises at least one steel plate.

16. The electrical connector of claim 1, further comprising at least one mating alignment device on each of said first and second surfaces.

17. The electrical connector of claim 16, wherein the at least one alignment device on the first and second surfaces comprises an alignment pin and a mating alignment recess.

18. The electrical connector of claim 16, wherein the at least one alignment device comprises said at least one first electrical contact projecting from said first surface.

* * * * *